US007043845B2

(12) United States Patent
Lukens

(10) Patent No.: US 7,043,845 B2
(45) Date of Patent: May 16, 2006

(54) TRIM ATTACHMENT FOR PORTABLE CIRCULAR SAW

(76) Inventor: Charles R. Lukens, P. O. Box 127, Bull Head City, AZ (US) 86430

( * ) Notice: Subject to any disclaimer, the term of this patent is extended or adjusted under 35 U.S.C. 154(b) by 0 days.

(21) Appl. No.: 11/036,058

(22) Filed: Jan. 18, 2005

(65) Prior Publication Data

US 2006/0042102 A1 Mar. 2, 2006

Related U.S. Application Data

(60) Provisional application No. 60/604,838, filed on Aug. 27, 2004.

(51) Int. Cl.
*B27B 9/04* (2006.01)
*B27B 21/08* (2006.01)

(52) U.S. Cl. ..... 30/370; 30/371; 30/374; 30/377

(58) Field of Classification Search ..... 30/370–375, 30/377; D8/66; 409/180–182; 451/451, 451/452, 457; 83/454, 745, 574
See application file for complete search history.

(56) References Cited

U.S. PATENT DOCUMENTS

| | | | | | |
|---|---|---|---|---|---|
| 1,911,045 | A | * | 5/1933 | Tinnen | 83/574 |
| 2,623,557 | A | * | 12/1952 | Kendall | 30/373 |
| 3,481,374 | A | * | 12/1969 | Schindler | 30/373 |
| 3,979,987 | A | * | 9/1976 | Mayhew et al. | 83/454 |
| 4,016,649 | A | | 4/1977 | Kloster | |
| 4,059,038 | A | | 11/1977 | Rietema | |
| 4,062,391 | A | * | 12/1977 | Piazzola | 451/451 |
| 4,077,292 | A | * | 3/1978 | Cole | 30/372 |
| 4,483,071 | A | | 11/1984 | te Kolsté | |
| 4,577,526 | A | * | 3/1986 | Stäbler | 451/451 |
| 4,624,054 | A | * | 11/1986 | Edwards | 30/374 |
| 4,761,884 | A | * | 8/1988 | Nguyen et al. | 30/373 |
| 4,867,425 | A | * | 9/1989 | Miraglia, Jr. | 30/372 |
| 5,084,977 | A | * | 2/1992 | Perkins | 30/374 |
| 5,103,566 | A | * | 4/1992 | Stebe | 30/376 |
| 5,921,161 | A | * | 7/1999 | Newell | 83/745 |
| 6,484,410 | B1 | | 11/2002 | Meastas | |
| 2004/0010926 | A1 | | 1/2004 | Hampton | |

FOREIGN PATENT DOCUMENTS

| | | |
|---|---|---|
| DE | 3520309 | 12/1986 |

* cited by examiner

*Primary Examiner*—Timothy V. Eley
*Assistant Examiner*—Jason Prone

(57) ABSTRACT

The trim attachment for a portable circular saw is generally L-shaped, having a generally rectangular, planar, horizontal mounting plate and a perpendicular fence extending downward from a lengthwise side thereof. The perpendicular fence forms an insert portion therealong for receiving the blade guard of the circular saw. The mounting plate is adjustably mounted to the shoe of the portable circular saw on the underside of the shoe using carriage bolts that pass through, and are adjustable along, slots cut into the mounting plate and through corresponding holes in the shoe of the saw, and that are secured by wing nuts. Trim of relatively small width may be easily and accurately cut from a common wood member, such as a 2"×2"–2"×8" members. The trim attachment may also be useful in dressing the edge of a wood member.

18 Claims, 6 Drawing Sheets

TRIM ATTACHMENT FOR PORTABLE CIRCULAR SAW

CROSS-REFERENCE TO RELATED APPLICATION

This application claims the benefit of U.S. Provisional Patent Application Ser. No. 60/604,838, filed Aug. 27, 2004.

BACKGROUND OF THE INVENTION

1. Field of the Invention

The present invention relates to fences for handheld, portable circular saws. More particularly, the present invention relates to a fence attachable to the base or shoe of a portable circular saw for cutting trim of desired thickness from an elongated workpiece.

2. Description of the Related Art

The use of handheld, portable circular saws is widespread, particularly in the building industries. There are numerous designs for guides to be attached to such handheld portable circular saws (referred to herein as "portable circular saw") to provide more accurate cuts or for ripping sheet material. These guides are generally complicated in design, making them expensive to purchase and time consuming to install and remove from the circular saw. Known guides of this type are not specifically designed to cut trim pieces from common wood members. Some portable circular saws are equipped with a rip guide formed from a rod with a short plate transverse to the end of the rod, the rod being extendible from the base so that the plate at the end of the rod can ride against a guide of stock wood clamped to the workpiece. However, the span of the plate at the end of the rod is generally only about two inches long, which requires that the guide stock be straight to ensure a straight rip cut; otherwise the saw will follow small imperfections in the guide stock.

It would be desirable to provide a fence adjustably attached by screws with wing nuts to the shoe of such a circular saw and that provides the capability to cut accurate trim pieces of a desired thickness and substantial length from common elongated wood stock, such as a 2"×2", 2"×4", 2"×6", 2"×8" members, etc.; and similar stock of 2½" thickness.

Thus, a trim attachment to a circular saw solving the aforementioned problems is desired.

SUMMARY OF THE INVENTION

The trim attachment for a portable circular saw is generally L-shaped, having a generally rectangular, planar, horizontal mounting plate and a perpendicular fence extending downward from a lengthwise side thereof. The perpendicular fence forms an insert portion therealong for receiving the blade guard of the circular saw. The mounting plate is adjustably mounted to the shoe of the portable circular saw on the underside of the shoe using carriage bolts that pass through, and are adjustable along, slots cut into the mounting plate and through corresponding holes in the shoe of the saw, and that are secured by wing nuts. Trim of relatively small width may be easily and accurately cut from a common wood member, such as a 2"×2", 2"×4", 2"×6", 2"×8" members, etc., and similar stock of 2½" thickness. The trim attachment may also be useful in dressing the edge of a wood member.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
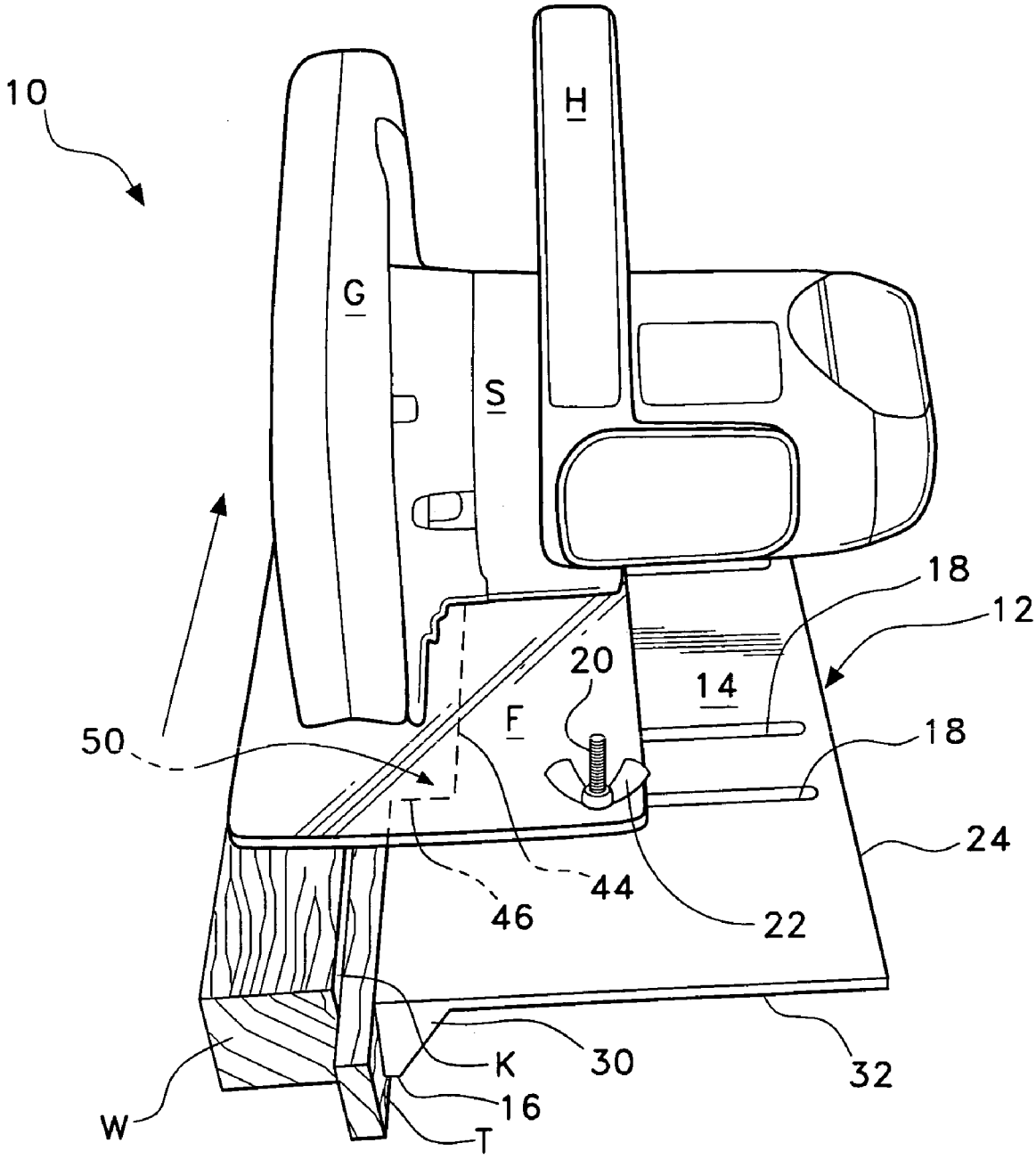
FIG. 1 is an environmental, perspective view of a trim attachment to portable circular saw according to the present invention as viewed from above.

The present invention is a trim cutting attachment for handheld or portable circular saws, useful for accurately cutting relatively thin trim pieces from common, elongated workpieces, such as housing stud material.

Referring to FIGS. 1–5, there is shown top and bottom environmental perspective views, an environmental front elevation view, an exploded view, and a plan view, respectively, of the circular saw trim attachment system, referred to herein by the reference number 10. Trim attachment system 10 includes trim cutting attachment 12 mounted on a portable circular saw S. Trim cutting attachment 12 has an elongate, generally rectangular, horizontal, planar mounting plate 14 from which depends an elongate fence 16 for contacting a side of the elongated wood stock W. As shown, trim system 10 guides saw S when cutting trim T from wood stock W along kerf K. Saw S has a guard G covering a circular blade B (see FIG. 2), a handle H, and a flat shoe F supporting saw S as it is guided by the operator. Mounting plate 14 has spaced parallel adjustment slots 18 and is attached to the underside of shoe F by removable fasteners such as carriage bolts 20 extending through mounting holes 38 in shoe F (the thickness of the base plate or shoe F is exaggerated in FIG. 3, the shoe F generally being a thin metal plate). The drilling of the mounting holes 38 in shoe F is the only modification required to mount the trim attachment 12 to a portable circular saw. The provision of four adjustment slots allows for universal mounting to the shoe of all commonly used hand-held circular saws.

Figure 2:
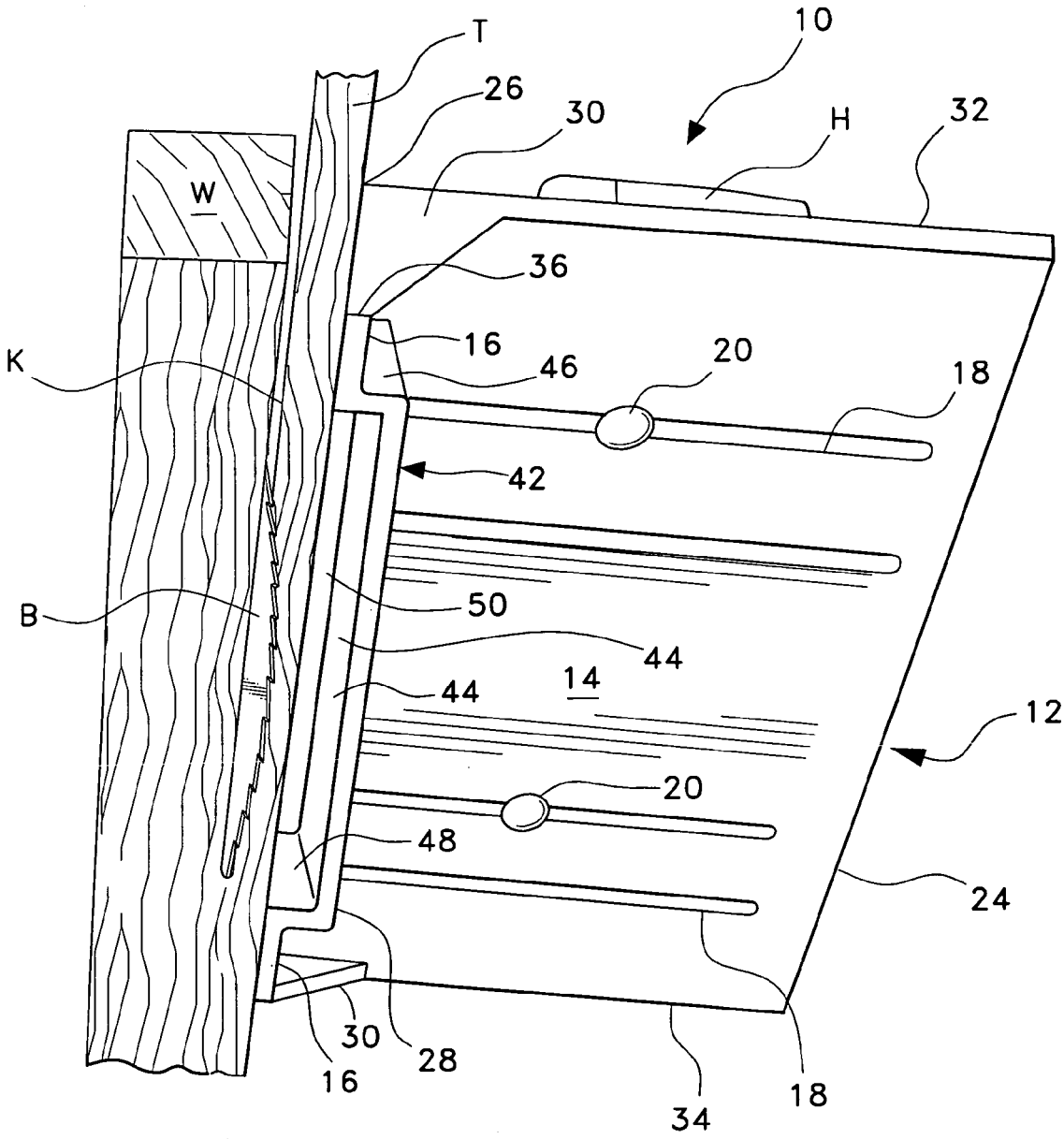
FIG. 2 is an environmental, perspective view of the trim attachment of FIG. 1 as viewed from below.
Figure 3:
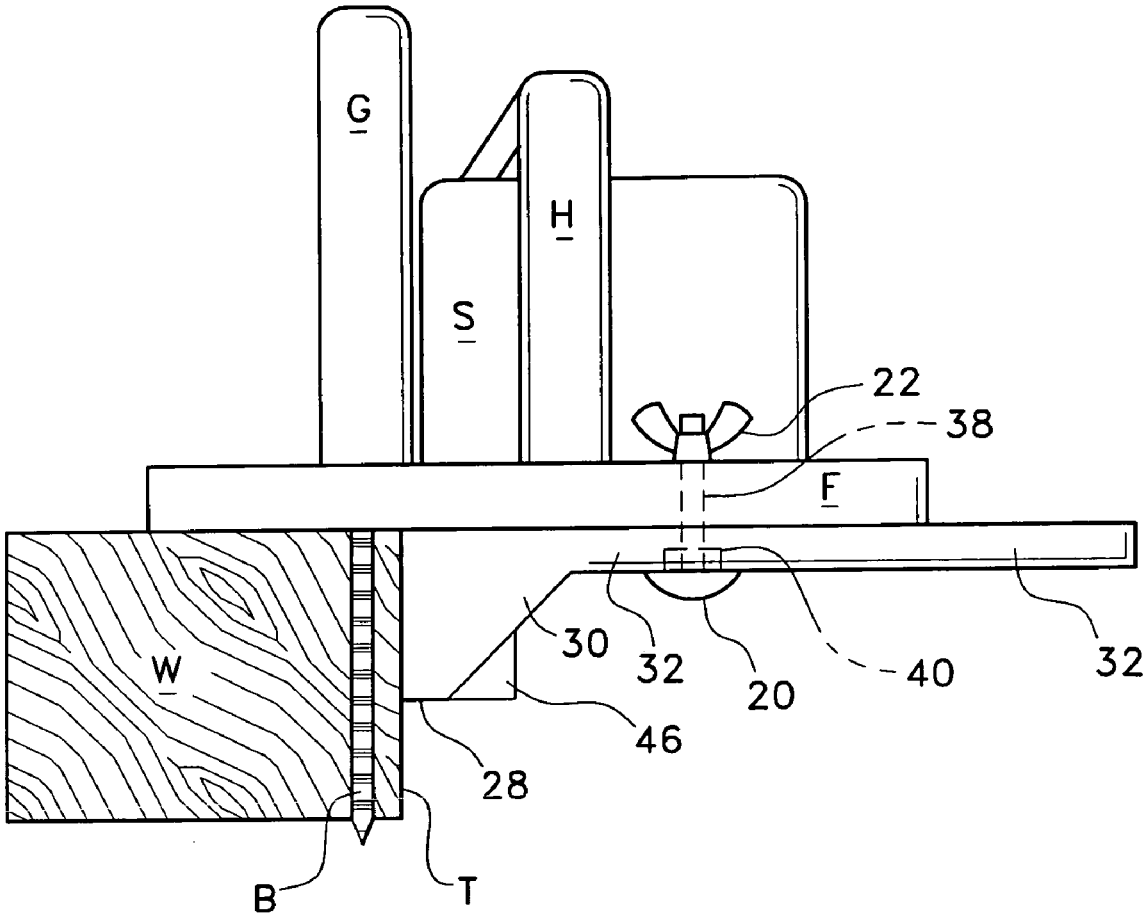
FIG. 3 is an environmental front elevation view of the trim attachment of FIG. 1.
Figure 4:
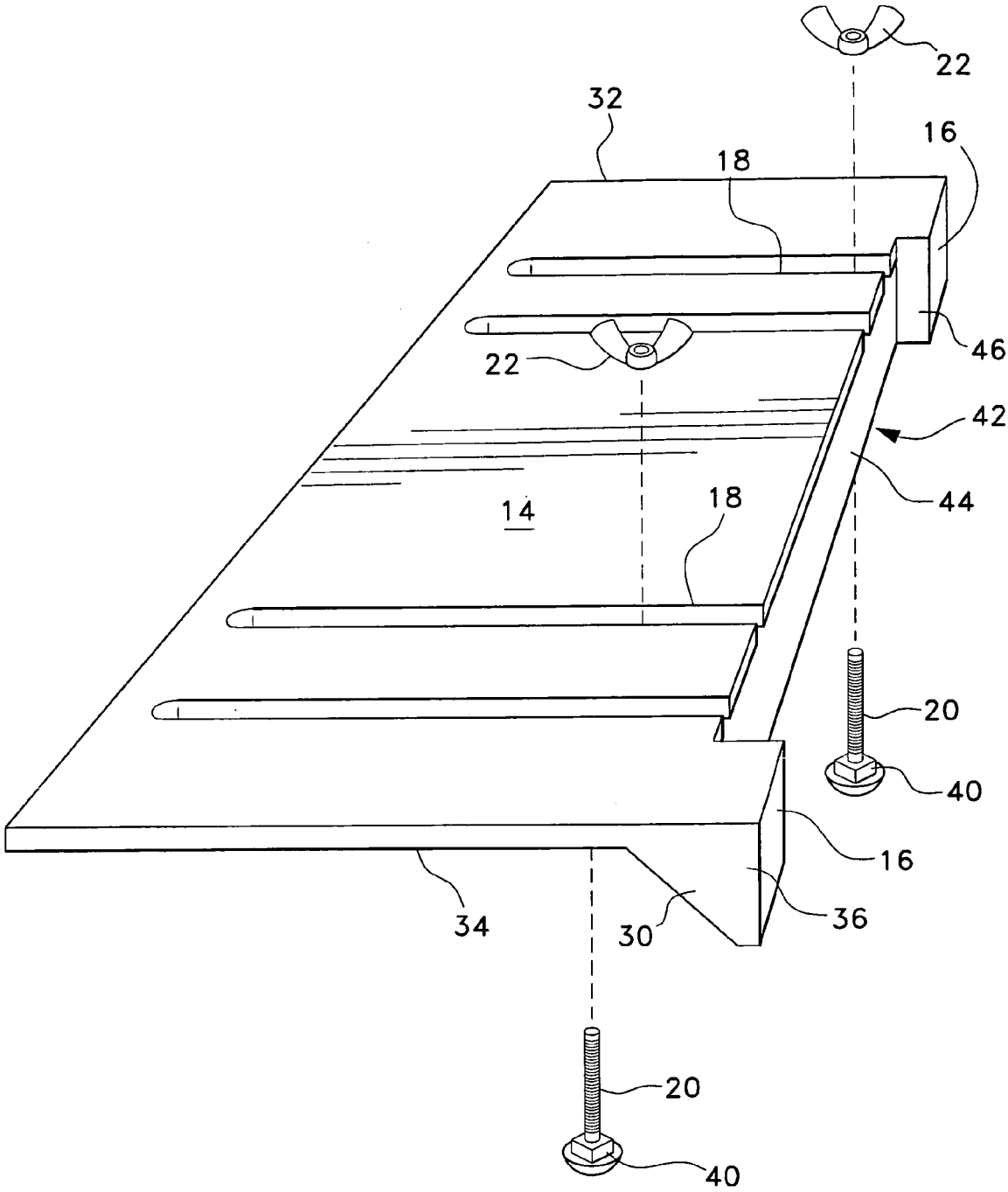
FIG. 4 is an exploded perspective view of the trim attachment of FIG. 1.
Figure 5:
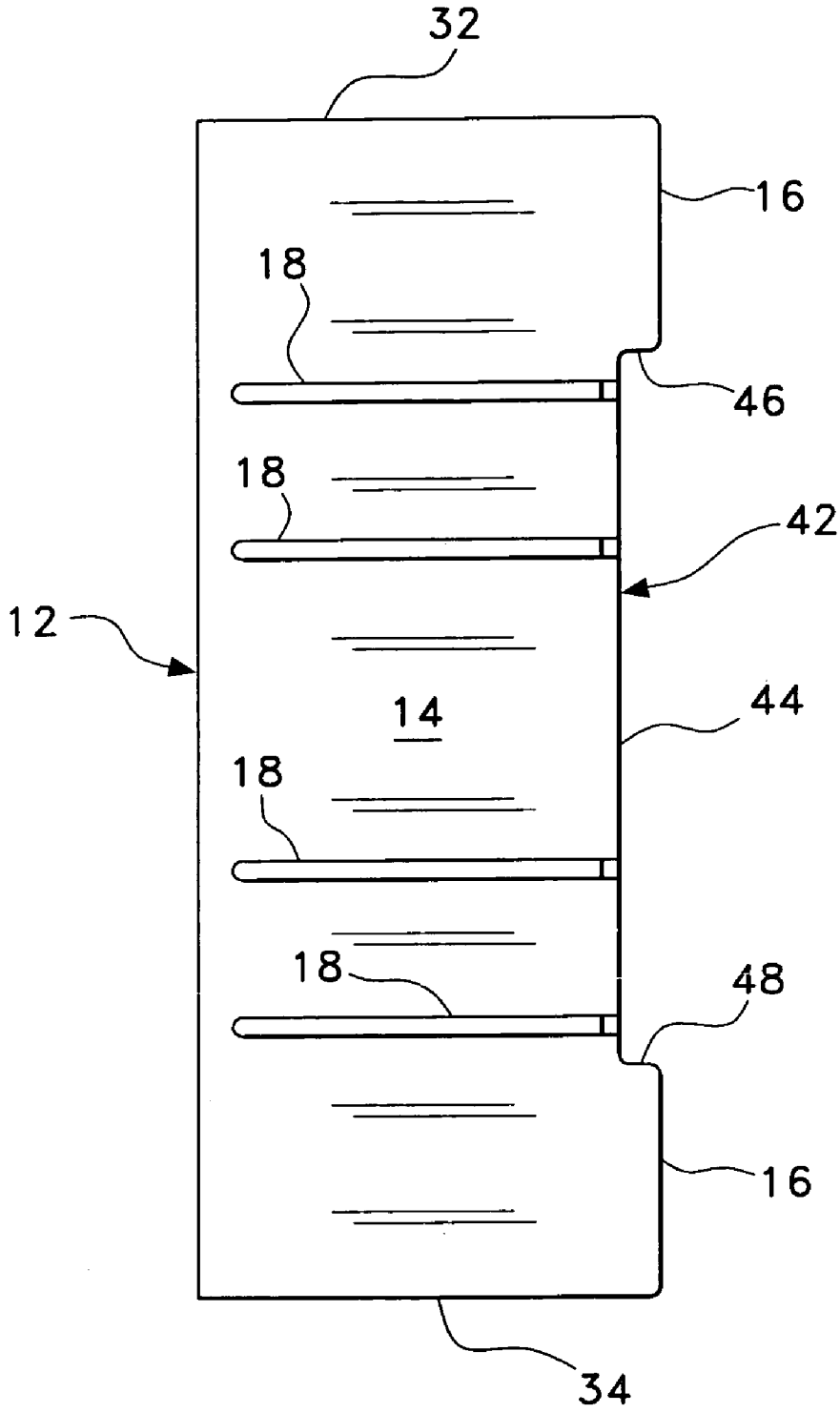
FIG. 5 is a plan view of the trim attachment of FIG. 1.

As best seen in FIGS. 2, 3, and 4, fence 16 and mounting plate 14 include an inset portion 42 located about halfway between the mounting plate forward edge 34 and rear edge 32 and forming a receiving space 50 for receiving the lower portion of the saw guard G. This allows the use of the saw guard while cutting thin trim T. Fence inset portion 42 includes inset sidewall 44, inset rear wall 46 and inset front wall 48 connecting with the forward and rearward portions of fence 16.

The drilling of holes 38 is the only modification to the saw S required for mounting and use of the trim cutting attachment 12 therewith. Carriage bolts 20 extend through adjustment slots 18 and are fastened with wing nuts 22 which are easily loosened for lateral adjustment of mounting plate 14 relative to shoe F along adjustment slots 18 to obtain a desired thickness of trim T, and then easily tightened to secure trim cutting attachment 12 for use. Although at least four adjustment slots 18 are provided, normally only two are used as shown in FIG. 2, the slots used depending on the particular configuration of the flat shoe F and the saw S, thus allowing for use of differing brands of circular saws.

Mounting plate 14 has a free edge 24, and a fence edge 26 from which the front and rear portions of fence 16 perpendicularly depend. End gussets 30 reinforce the joint of mounting plate 14 and the fence 16. Mounting plate 14 has a rear edge 32 and a forward edge 34. Fence 16 has a bottom edge 28 and a rear edge 36. The heads (see FIG. 3) of carriage bolts 20 may be flattened as desired by filing to make a more consistently flat lower side of mounting plate 14 in use. Also, the heads of carriage bolts 20 may be countersunk in grooves (not shown) on each side of adjustment slots 18 as desired.

Referring to FIG. 4, there is shown an exploded view of the trim cutting attachment 12 wherein carriage bolts 20 are shown separated from the unitary mounting plate 14 and fence 16. Mounting plate 14 and fence 16 may by easily made by molding of appropriate plastic material. Of course, guide plate 16 with insert portion 42 may be separately provided and attached along the edge of mounting plate 14. Carriage bolt head squares 40 are of such size relative to the width of adjustment slots 18 that carriage bolts 20 will not turn in slots 18 during the tightening process using wing nuts 22, however they are of such relative dimensions that carriage bolts 20 will easily slide laterally within slots 18 when wing nuts 22 are loosened for adjustment of the trim cut.

Figure 6:
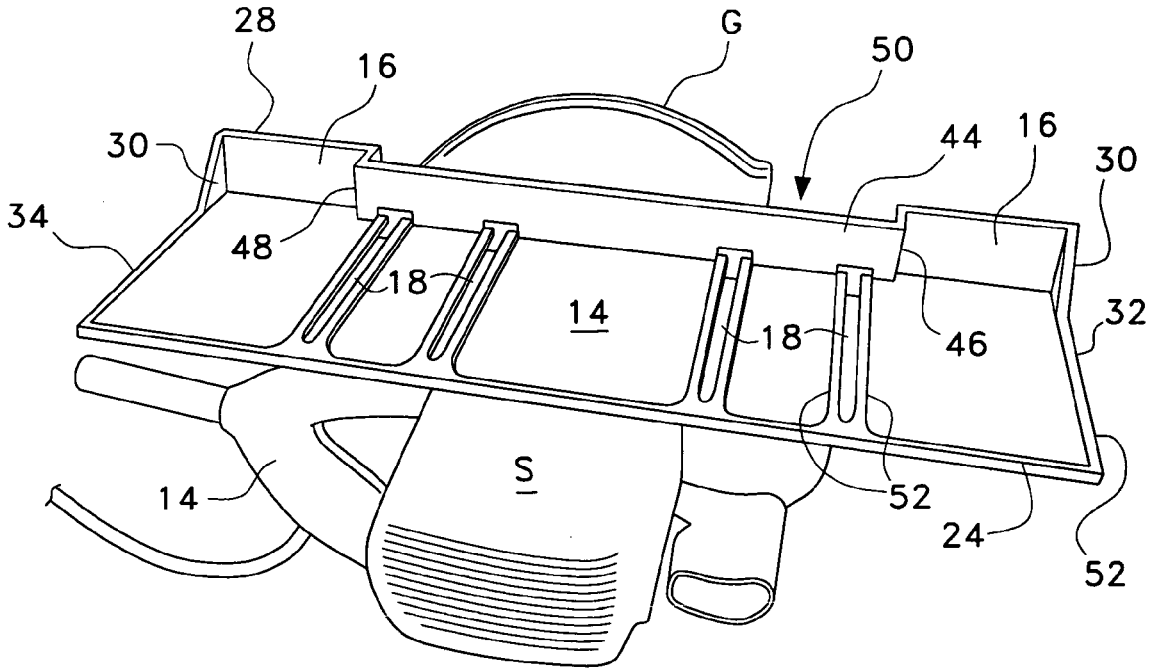
FIG. 6 is a bottom perspective view of the trim attachment of FIG. 1.

Referring to FIG. 6, there is shown a bottom perspective view of the trim attachment of the present invention as mounted on a circular saw with the saw guard G fit within insert space 50 for a thin trim cut. The mounting plate 14 is shown as molded with molding 52 surrounding the mounting plate 14 and the adjustment slots 18 of a thickness twice that of mounting plate 14 so as to allow minimum use of plastic material while providing reinforcement where needed.

In operation, trim cutting attachment 12 is attached to the underside of shoe F by inserting carriage bolts 20 upward through adjustment slots 18 in mounting plate 14, and through holes 38 in shoe F where wing nuts 22 are attached and turned on bolts 20 until tight. The desired trim thickness may be set by loosening wing nuts 22 so as to allow lateral adjustment along slots 18 until fence 16 is at the desired point to cut the desired thickness of trim T. This may be done by adjusting to a scroll line on the workpiece or measuring between the guide plate 16 and the saw blade B taking into account the width of kerf K. Wing nuts 22 are then tightened and the sawing operation undertaken by moving the saw along the workpiece with the guide plate 16 against the square side of the workpiece W. The trim cutting attachment 12 may quickly be removed from the saw S by unscrewing wing nuts 22 and letting the trim cutting attachment 12 and carriage bolts 20 fall away from the shoe F of saw S.

The trim cutting attachment does not interfere with the setting of the shoe F relative to the saw blade B as is frequently done to adjust depth of cut and angle of cut, nor is it necessary to clamp a guide stock to the workpiece W. The trim cutting attachment, with appropriate saw blade, also allows the easy dressing of rough sides of elongate wood members, taking the place of a wood plane.

In the preferred embodiment, the fence 16 is preferably a 1⅜" lip extending perpendicularly downward from mounting plate 14. The fence 16 can be adjusted to any distance between 1/32" and 3¾" from the saw blade B on common power saws such as the largest Makita saw. If a saw is used having a shoe reaching 6" from the saw blade, then up to a 5" cut may be made. The holes 38 in the shoe S are ¼" in diameter and the bolts 20 are ¾"×¼" carriage bolts. The mounting plate 14 and fence 16 are about 15" in total length. The mounting plate 14 is about 5¾" in width with the fence inset extending inward about ⅝". The adjustment slots 18 are about 4½" in length. The slots 18 are about ¼" in width. The thickness of the mounting plate 14 and fence 16 is about 3/16" with the reinforcing molding about ⅜" in thickness when molded of plastic.

The trim cutting system of the present invention may be used with cement block, brick, aluminum fabrications, etc. depending on the type of circular saw blade used.

It is to be understood that the present invention is not limited to the embodiments described above, but encompasses any and all embodiments within the scope of the following claims.

I claim:

1. A trim attachment for a portable circular saw, comprising:

an elongate, generally rectangular, mounting plate having a forward edge, a rear edge, a free edge and an opposing edge, the mounting plate having at least two spaced, parallel adjustment slots defined therein;

an elongate fence depending from said opposing edge of said mounting plate, wherein said fence includes an inset portion, said inset portion being located at a point between said forward edge and said rear edge of said mounting plate, said inset portion extending inward within said mounting plate and defining a saw guard receiving space; and a removable fastener extending through each of said at least two slots and adapted for extending through a corresponding one of front and rear mounting holes defined in a shoe of the circular saw;

whereby, said mounting plate is laterally adjustable relative to the shoe in order to space the fence a selected distance from the blade of the circular saw; and whereby, upon operating said circular saw with said fence against a planar side of an elongated workpiece, a trim piece of desired thickness is cut.

2. The trim attachment of claim 1, wherein said fence extends the length of said mounting plate between said forward edge and said rear edge.

3. The trim attachment of claim 1, wherein said inset portion of said fence is located about halfway between said forward edge and said rear edge of said mounting plate.

4. The trim attachment of claim 1, wherein said removable fastener is a carnage bolt and wing nut, said carriage bolt having a square head portion, each said slot being of such width as to slidingly receive the square head portion of said removable fastener, said fasteners extending through respective slots and said mounting holes of said shoe and secured in place by respective wing nuts, whereby, upon loosening said wing nuts, said mounting plate and fence are laterally adjustable relative to said shoe and upon tightening said wing nuts said mounting plate is fixed relative to said shoe.

5. The trim attachment of claim 4, wherein said at least two parallel spaced adjustment slots comprise four adjustment slots.

6. The trim attachment of claim 4, wherein said inset portion of said fence is generally rectangular and formed by a fence inset sidewall and inset front and rear walls.

7. The trim attachment of claim 6, further comprising front and rear gussets extending between said fence and said mounting plate forward edge and between said fence and said rear edge, respectively.

8. A trim attachment for a portable circular saw, comprising:

an elongate, generally rectangular, mounting plate having a forward edge, a rear edge, a free edge and an opposing edge, the mounting plate having at least two spaced, parallel adjustment slots defined therein;

an elongate fence depending from said opposing edge of said mounting plate and having an inset portion; and a removable fastener extending through each of said at least two slots and adapted for extending through a corresponding one of front and rear mounting holes defined in a shoe of the circular saw;

said inset portion being located at a point between said forward edge and said rear edge of said mounting plate, said inset portion extending inward within said mounting plate and defining a saw guard receiving space;

whereby, said mounting plate is laterally adjustable relative to the shoe in order to space the fence a selected distance from the blade of the circular saw; and whereby, upon operating said circular saw with said fence against a planar side of an elongated workpiece, a trim piece of desired thickness is cut.

9. The trim attachment of claim 8, wherein said fence extends the length of said mounting plate between said forward edge and said rear edge.

10. The trim attachment of claim 8, wherein said removable fastener is a carriage bolt and wing nut, said carriage bolt having a square head portion, each said slot being of such width as to slidingly receive the square head portion of said removable fastener, said fasteners extending through respective slots and said mounting holes of said shoe and secured in place by respective wing nuts, whereby, upon loosening said wing nuts, said mounting plate and fence are laterally adjustable relative to said shoe and upon tightening said wing nuts said mounting plate is fixed relative to said shoe.

11. The trim attachment of claim 8, wherein said inset portion of said fence is generally rectangular and formed by a fence inset sidewall and inset front and rear walls.

12. The trim attachment of claim 11, further comprising front and rear gussets extending between said fence and said mounting plate forward edge and between said fence and said rear edge, respectively.

13. A trim attachment circular saw system, comprising in combination:

a portable circular saw having a shoe, the shoe having a pair of spaced apart, front and rear holes defined therein;

an elongate mounting plate having a free edge and an opposing edge, the mounting plate having at least two spaced, parallel adjustment slots opening at the free edge;

an elongated fence depending from the opposing edge of said mounting plate, wherein said fence includes an inset portion, said inset portion being located at a point between said forward edge and said rear edge of said mounting plate, said inset portion extending inward within said mounting plate and defining a saw guard receiving space; and a removable fastener extending through each of the slots and through a corresponding one of the holes;

whereby, said mounting plate is laterally adjustable relative to the shoe in order to space the fence a selected distance from a blade of the circular saw;

whereby, upon operating said circular saw with said fence against a planar side of an elongated workpiece, a trim piece of desired thickness is cut.

14. The trim attachment of claim 13, wherein said removable fastener is a carriage bolt and wing nut, said carriage bolt having a square head portion, each said slot being of such width as to slidingly receive the square head portion of said removable fastener, said fasteners extending through respective slots and said mounting holes of said shoe and secured in place by respective wing nuts, whereby, upon loosening said wing nuts, said mounting plate and fence are laterally adjustable relative to said shoe and upon tightening said wing nuts said mounting plate is fixed relative to said shoe.

15. The trim attachment of claim 14, wherein said inset portion of said fence is located about half-way between said forward edge and said rear edge of said mounting plate.

16. The trim attachment of claim 15, wherein said fence extends the length of said mounting plate between said forward edge and said rear edge.

17. The trim attachment of claim 16, wherein said inset portion of said fence is generally rectangular and formed by a fence inset sidewall and inset front and rear walls.

18. The trim attachment of claim 17, further comprising front and rear gussets extending between said fence and said mounting plate forward edge and between said fence and said rear edge, respectively.

* * * * *